United States Patent [19]

Ruch et al.

[11] 4,388,887

[45] Jun. 21, 1983

[54] WINDING DEVICE FOR A SEWING MACHINE

[75] Inventors: Urs Ruch, Berlingen; Christian Ulmer, Steckborn, both of Switzerland

[73] Assignee: Fritz Gegauf Aktiengesellschaft Bernina-Nähmaschinenfabrik, Steckborn, Switzerland

[21] Appl. No.: 214,474

[22] Filed: Dec. 9, 1980

[30] Foreign Application Priority Data

Dec. 19, 1979 [CH] Switzerland ..... 11240

[51] Int. Cl.[3] ..... D05B 59/00

[52] U.S. Cl. ..... 112/279; 112/271

[58] Field of Search ..... 112/279, 259, 271, 258; 312/24

[56] References Cited

U.S. PATENT DOCUMENTS 3,665,875 5/1972 Bantor ..... 112/279

FOREIGN PATENT DOCUMENTS 788050 12/1957 United Kingdom ..... 112/279

2065730 7/1981 United Kingdom ..... 112/279

*Primary Examiner*—Werner H. Schroeder
*Assistant Examiner*—Andrew M. Falik
*Attorney, Agent, or Firm*—Birch, Stewart, Kolasch and Birch

[57] ABSTRACT

A winding device for a sewing machine including a sewing mechanism connected to a machine drive mechanism, by a coupling which comprises, a sewing machine housing, the winding device being movable to swing into the sewing machine housing and be covered by a lid when not being used. A two-armed hinge support is pivotally disposed on the housing and connected to the lid. One arm of the said two-armed hinge support is connected by a lever mechanism with a support, and the support is pivotally attached to the sewing machine housing for the winding device forming a toggle joint such that when the lid is opened the toggle joint is pushed through and the winding device is brought into its operating position and secured there while the other arm of the two-armed hinge support disengages said coupling between the machine drive mechanism and the sewing mechanism.

3 Claims, 6 Drawing Figures

WINDING DEVICE FOR A SEWING MACHINE

BACKGROUND AND SUMMARY OF THE INVENTION

The present invention is directed to a winding device for sewing machines which, when not being used, swings inside the sewing machine housing and is covered by a lid. Winding devices of the above type are known, for example, from DE-AS No. 1 043 773. The disadvantage of these winding devices is primarily the lack of protection against malfunction, particularly against the unintentional switching of the sewing mechanism to the on position when manipulating the winding device, which can lead to accidents. In addition, preparing to wind the device requires several hand operations.

In contrast, the present invention has as its object the creation of a winding device of the type mentioned which can be operated by one hand manipulation and can be locked in this position. Simultaneously the machine drive is automatically disengaged and the sewing machine is made inoperable. Closing the lid, on the other hand, analogously unlocks the mechanism, and lowering the winding device engages the machine drive with the sewing mechanism. For this purpose the winding device according to the present invention is characterized by the fact that the lid sits on a hinged support with two arms which are pivotingly attached to the housing. One of said arm forms a toggle hinge with a lever mechanism, including a support yoke for the winding device pivotingly attached to the housing, such that when the lid is opened the toggle joint is pushed through and the winding device is brought into its operating position where it is secured. The other arm of the hinged support disengages the coupling between the machine drive and the sewing mechanism.

A single hand manipulation is all that is needed to prepare the winding device, i.e. to open the lid. The connection between the lid and the sewing mechanism coupling guarantees that no possible type of manipulation of the winding device, when the lid is open, can cause the coupling to accidentally reengage. This eliminates the danger of damaging the sewing device or causing an accident. The winding device, which is completely contained and covered inside the housing, has no effect on the height of the machine or the design thereof.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
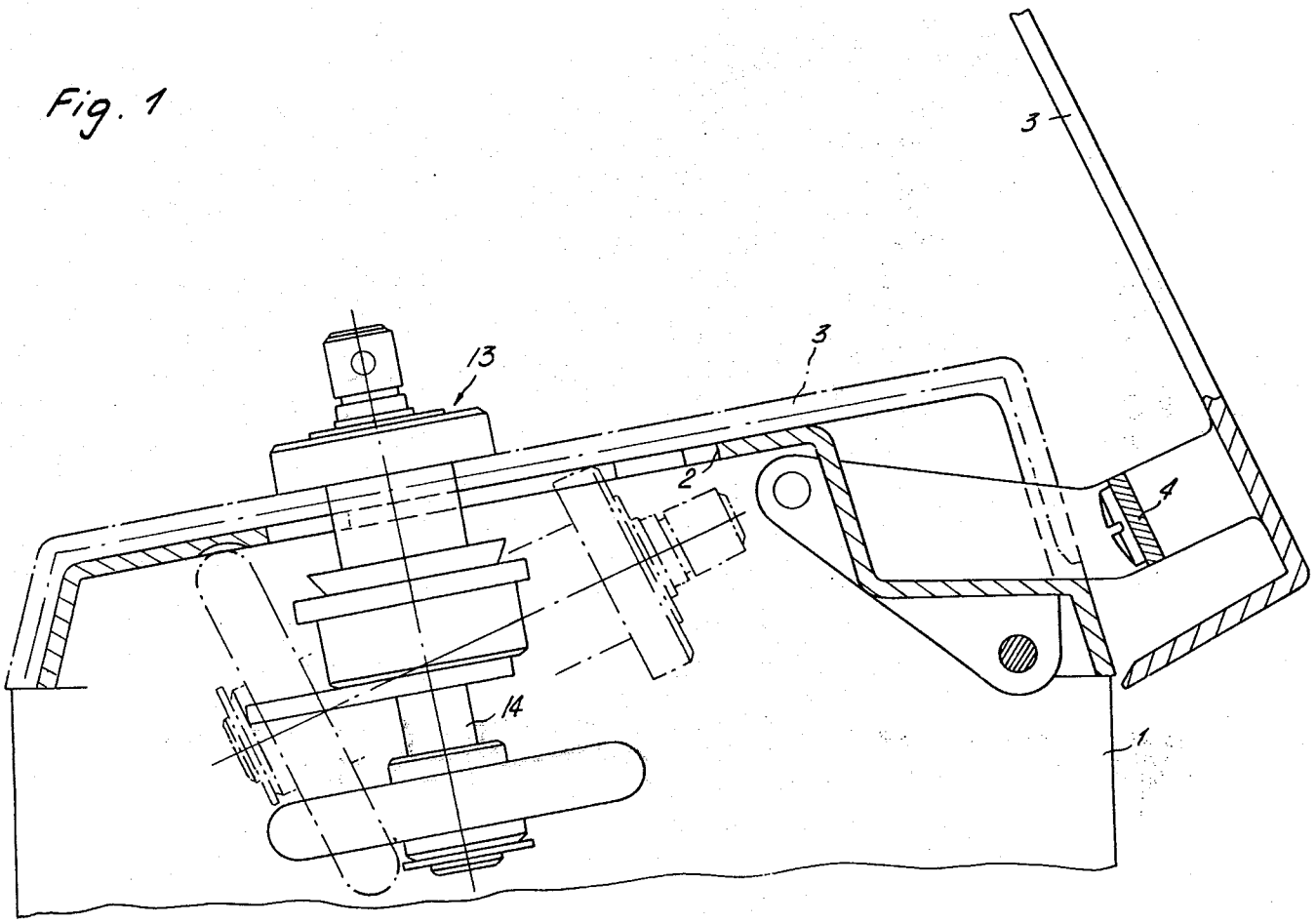
FIG. 1 shows a side view of the winding device in its operating position.
Figure 2:
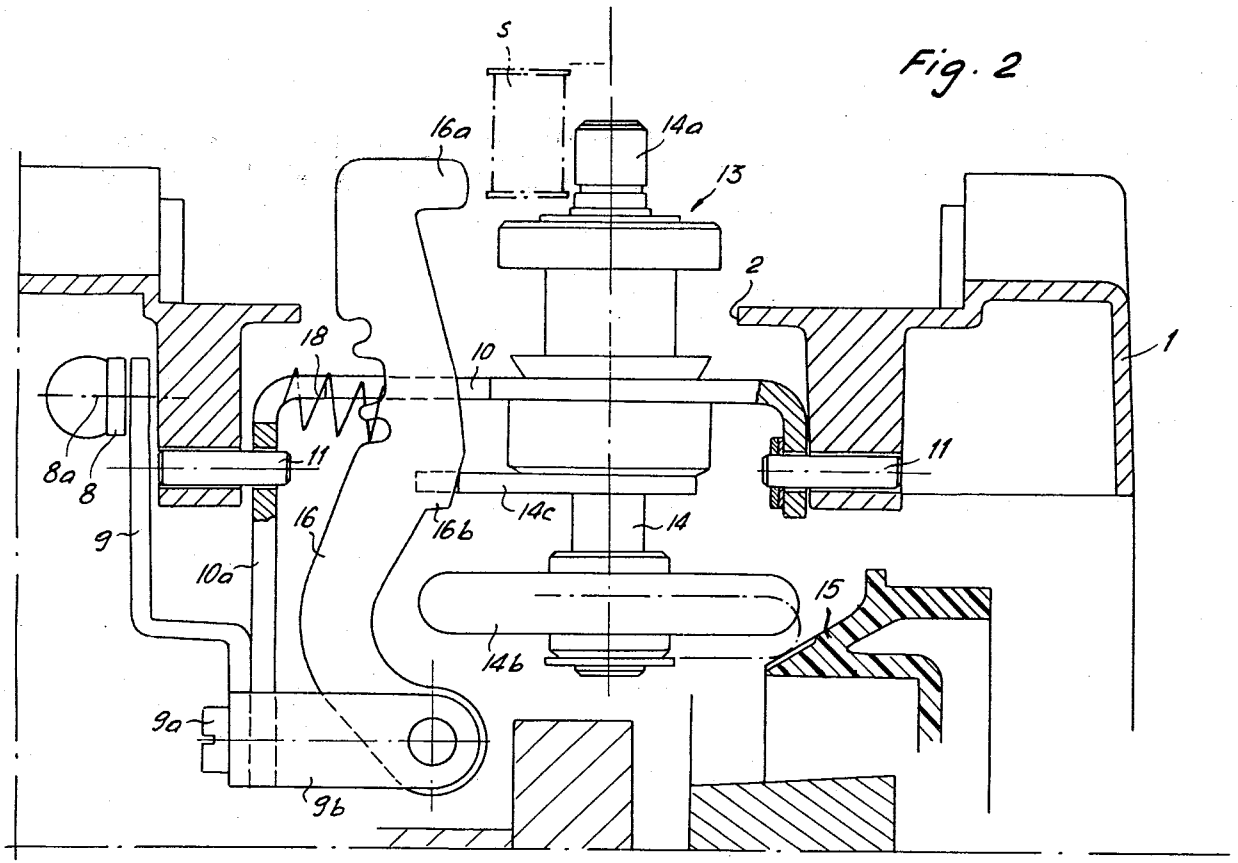
FIG. 2 shows a front view of the winding device swung up into its operating position.

In the drawing, element 1 designates the housing of a sewing machine. A housing wall opening 2 is covered by a lid 3 which can be swung open. The lid 3 is attached to a two-armed support 4 whose arms 5*a*, 5*b* are attached to the housing 1 by hinge pins 6*a*, 6*b*. The one arm 5*a* of the hinged support 4 has a slightly angled extension 7. The end of a push rod 8 is pivotingly attached to the middle position of the extension 7 at 7*a*. The other end of this push rod 8 is pivotally attached at point 8*a* to one end of an attachment angle 9. The off-set attachment angle 9 is connected at point 9*a* with the extended shank 10*a* of a U-shaped support 10. The support 10 is pivotingly attached to a housing 1 by axle pin 11. One end of a spring 12 is supported on this axle pin 11. The other end is supported at the free end 7*b* of the extension 7 of the hinged support arm 5*a*. The winding device 13 is attached to the transverse portion of support 10. The axially moveable winding shaft 14 with spool holder 14*a* at one end and drive wheel 14*b* at the other end is held by spring tension in a customary manner relative to the disengagement of the drive mechanism between the drive wheel 14*b* and the friction wheel 15 coupled with the machine drive. A keeper fork 14*c*, which moves along with the winder shaft 14 as it moves axially, works together with a lock lever 16. This lock lever 16, which can be pivoted in an axial plane running through the axles pins 11 of the winding device, is attached at one end to the side extension 9*b* of the attachment angle 9 and has at its other end a feeler lobe 16*a* which works together with the outside of the spool attached to the spool holder 14*a*. The lock lever 16, which is held by the force of a spring 18 against the winding device 13, is provided with a keeper lobe 16*b*, which is designed to work with the keeper fork 14*c*.

Figure 5:
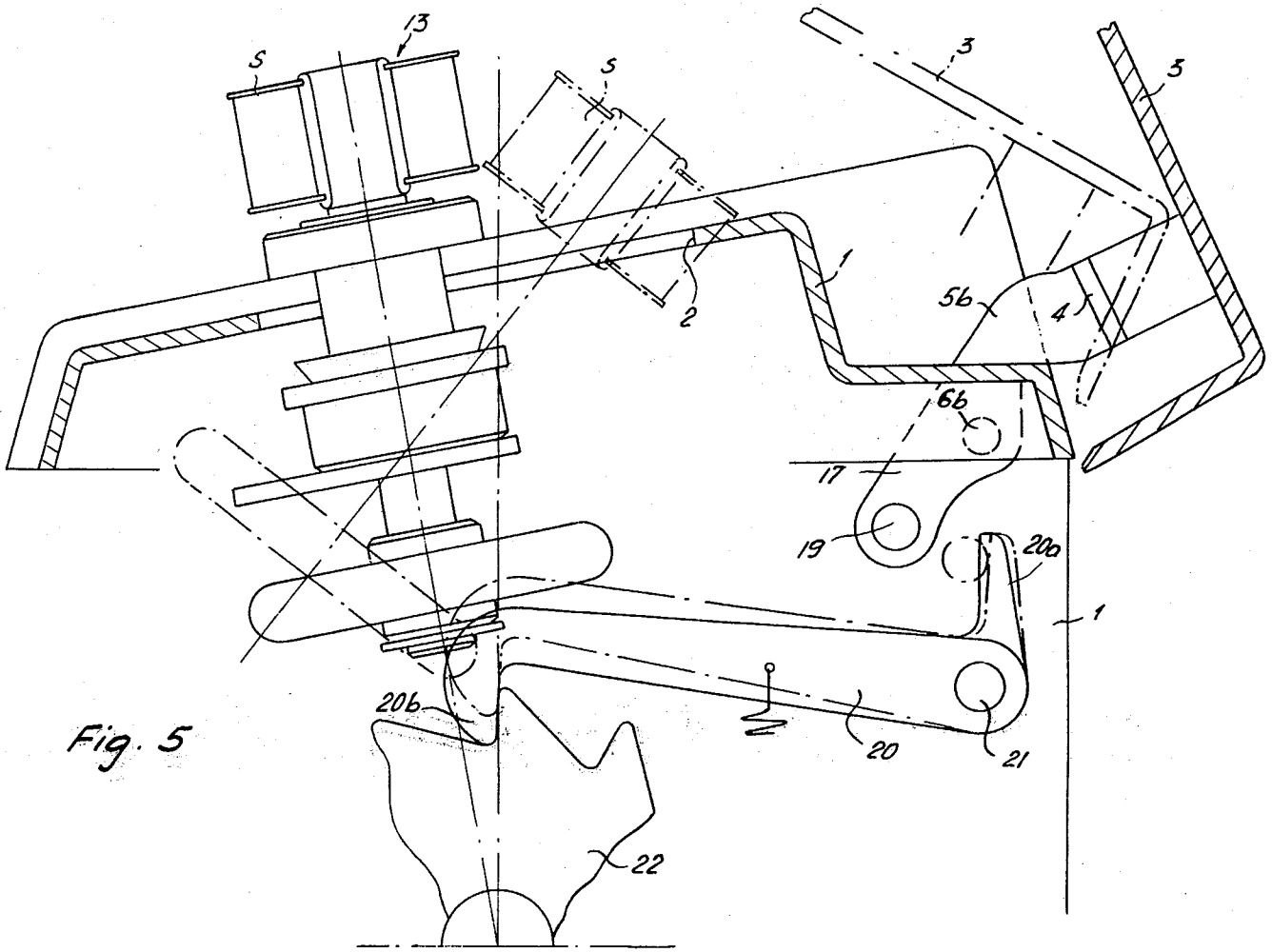
FIG. 5 shows a side view, analogous to FIG. 1 showing the means for disengaging the sewing mechanism drive.

As can be seen from FIG. 5 the second arm 5*b*, attached at 6*b* of the hinge support 4 of lid 3, is provided with an extension 17 which supports a transverse pin 19. This transverse pin 19 is designed to work together with the lobe 20*a* of the coupling lever 20 which is pivotingly attached to housing 1 around the perpendicular horizontal axis 21 relative to the pivot axis of lid 3. A latch 20*b* of the spring loaded coupling lever 20 works together with the ratchet teeth 22 of the spring sleeve of the torsion sleeve coupling (not shown in any more detail). The known torsion spring coupling lies between the functional member of the machine drive and the drive member of the sewing mechanism. When the sleeve rotates freely at one end of the torsion spring the torsion spring held at the other end of the drive member of the machine drive causes an engagement between the machine drive and the sewing mechanism, while when the sleeve is prevented from rotating the coupling is disengaged.

Figure 3:
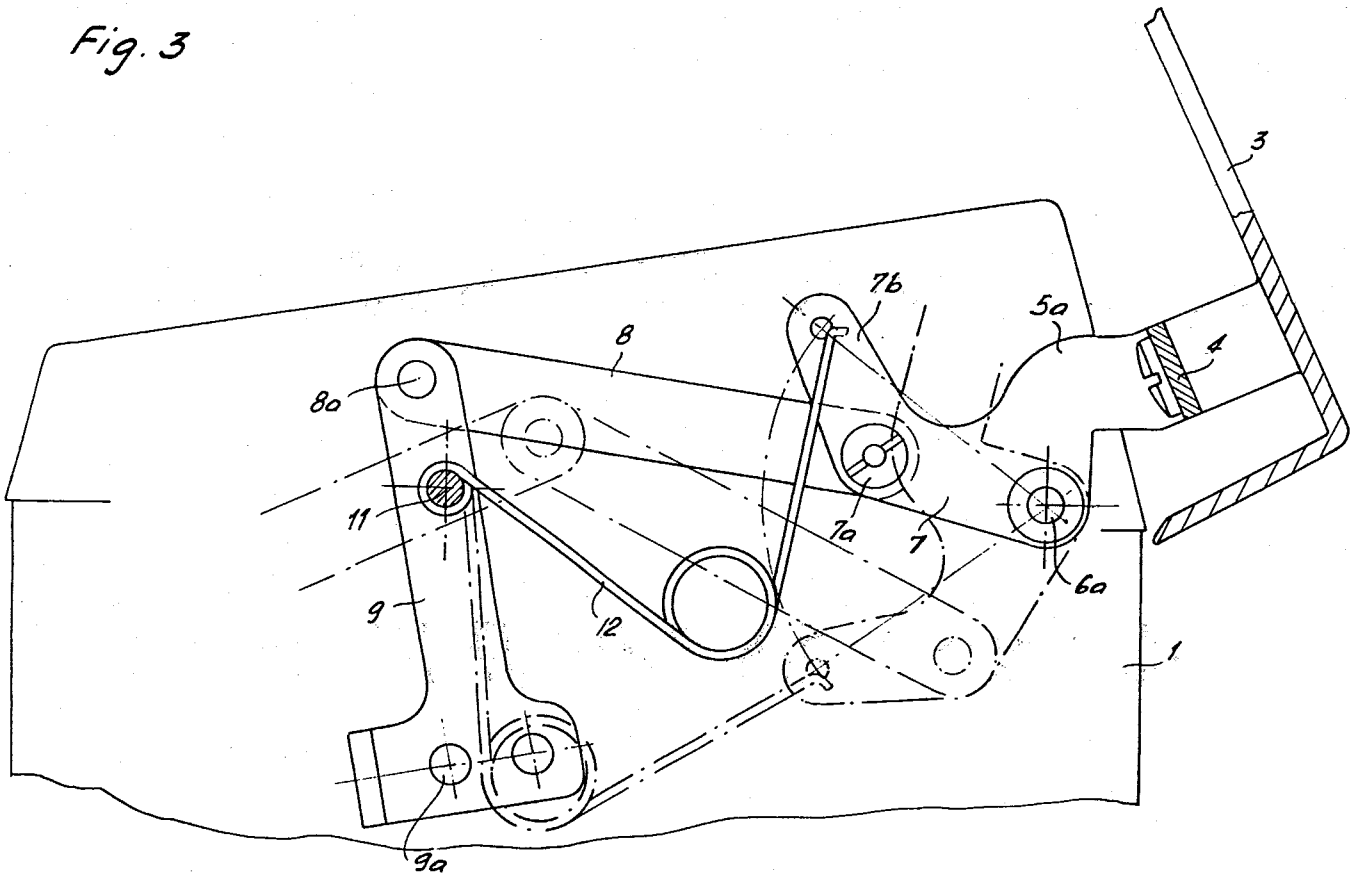
FIG. 3 shows a side view of the toggle lever connection of one of the hinged support arms with the winding device support.
Figure 4:
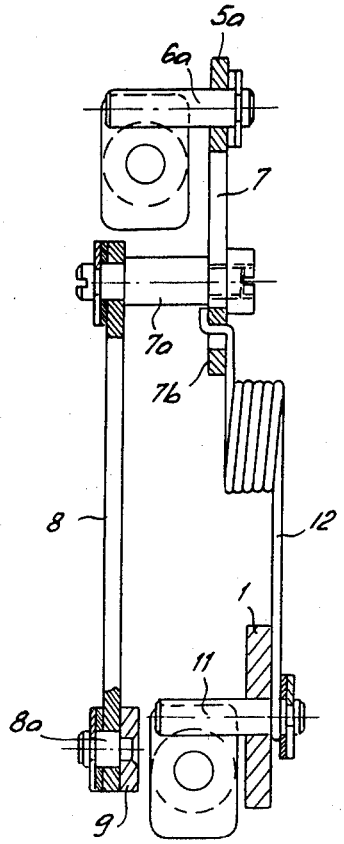
FIG. 4 shows a top view of the lever connection according to FIG. 3.

The following describes the manner of operation of the device of the present invention. When the lid 3 is swung into its open position the lever connection 7, 8, forming a toggle joint between the hinge support arm 5*a* and attachment angle 9, assumes the position shown in FIG. 3 with solid lines, i.e. the toggle joint is pushed out or extended (above) a short distance beyond its dead center position (the dead center position is determined by the straight line connection of the attachment points 6*a*, 7*a* and 8*a*) and secured by the torsion spring 12 in this position. The attachment location 9a of the extended shank 10a of the support 10 of the winding device 13 lies nearly perpendicularly under the axle pin 11 of support 10. The winding device 13, situated on the cross piece of support 10 extends with its spool holder 14a beyond the edge of the opening 2 of housing 1. The lock lever 16 engages in the keeper fork 14 above the keeper lobe 16b, whereby the feeler lobe 16a is held at sufficient distance from the axis of the winding device as to allow a spool to be placed on the spool holder 14a. Pressure on the spool moves the spring-loaded winding shaft 14 with the drive wheel 14b below into drive connection with friction wheel 15. Simultaneously the keeper fork 14c moves under the keeper lobe 16b of the lock lever 16 so that the winder shaft 14 is secured in its operating position. On the other hand the feeler lobe 16a of the lock lever 16 pushes into the winding area of the spools. During the winding process the lock lever 16 is pushed to the outside against the spring 18. This takes place as the diameter of the spool increases, thereby pushing the feeler lobe 16a which then in turn pushes the lock lever 16. This takes place until the spool is full and the keeper lobe 16b releases the keeper fork 14c and the drive wheel 14b of the winding shaft 14 is disengaged from the friction wheel 15 by the effect of spring tension. Now that the winder drive is engaged the full spools can be removed from the winding device 13 and the latter can be swung back into the housing by closing lid 3. In the process, as FIG. 3 shows, the toggle joint 7, 7a, 8 is bent out of its extended position beyond the dead center point (below) into the angled position shown with dotted lines. The torsion spring 12 is tensioned and then relaxed. The attachment angle 9 is swung away by push rod 8 taking with it support 10, which in turn moves the winding device 13 into its lowered position shown with dotted lines in FIG. 1. When the lid 3 is closed the transverse pin 19 makes contact with lobe 20a of the coupling lever 20 and pivots its latch 20d against the spring force of the coupling lever 20 out of engagement with the teeth 22 of the torsion spring coupling (FIG. 5). The device is designed so that the coupling lever 20 does not release the torsion spring coupling until the lid 3 is practically closed. Correspondingly, the sewing mechanism drive is not reengaged until the lid 3 is closed again. For example, as FIG. 5 shows, if a spool is left on the winding device 13 it bumps against the edge of the housing opening 2 when the lid 3 is closed so that lid 3 cannot be completely closed. The result is that the latch 20b of the coupling lever 20 does not release the teeth 22 of the torsion spring coupling, thus the sewing machine drive remains disengaged until the spool is removed from the winding device 13 and the lid 3 is completely closed. Any faulty manipulation of the winding device cannot, thereby, lead to a premature engagement of the sewing machine drive.

Figure 6:
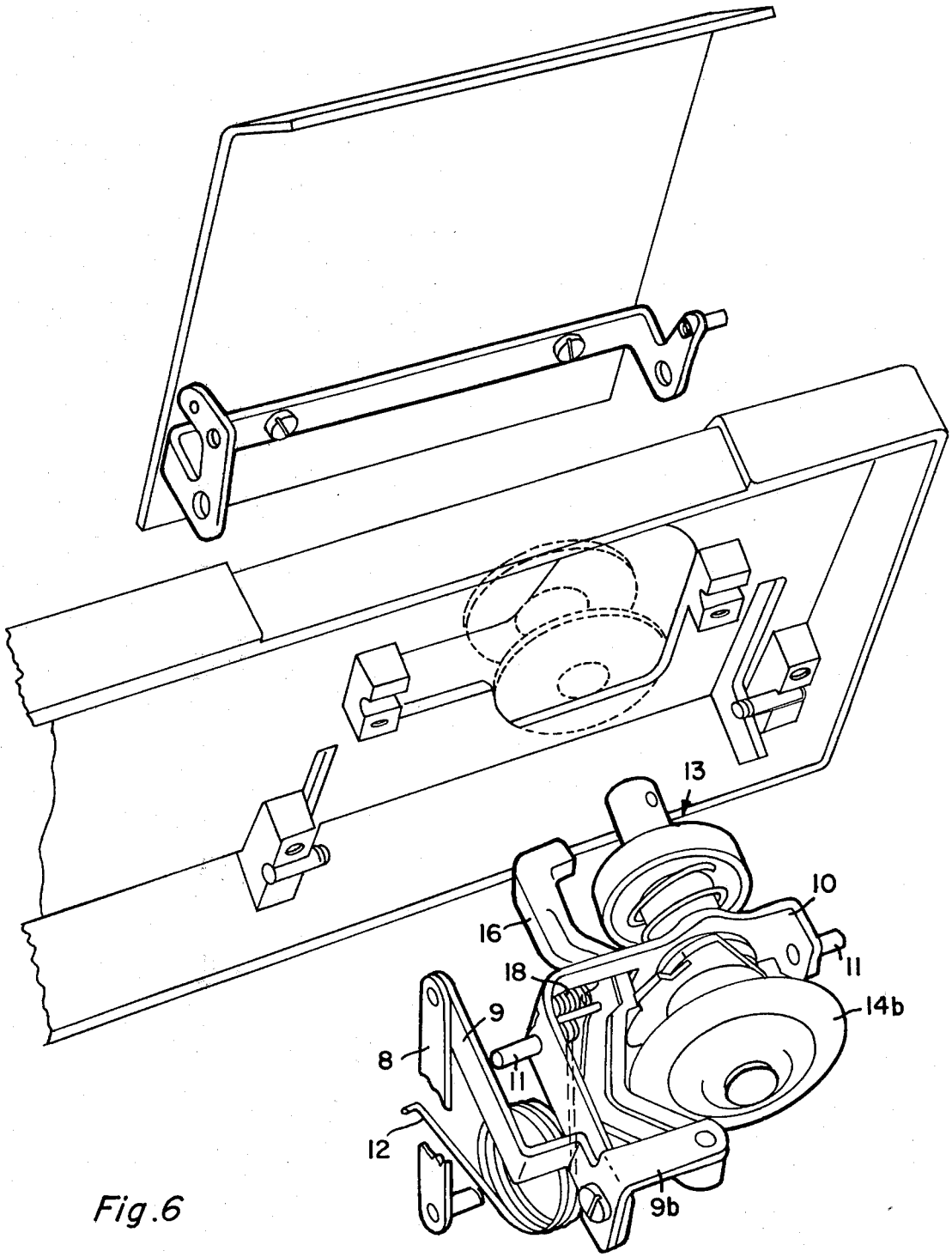
FIG. 6 is an isometric perspective view of the winding device of the present invention.

The isometric perspective view illustrated in FIG. 6 shows the drive wheel 14b in the closed, inoperative position with the lid detached to more clearly show the toggle joint.

The winding device described above can, as shown, be completely swung into the sewing machine housing by closing the lid, and by opening the lid can be brought out into its operating position where it can be secured.

As a brief summary it can be stated that the winding device 13 rests on a support 10 which is pivotingly attached in housing 1. By way of a lever mechanism 9, 8, 7 the support 10 is attached with one arm 5a of a U-shaped hinge support 4 forming a toggle joint 7a. The other arm 5b of the hinged support 4 works together with the lobe 20a of a coupling lever 20 attached in the housing 1. A latch 20b of the coupling lever 20 works with the teeth 22 of a sleeve of a torsion spring coupling. When opening the lid 3 the winding device 13 is swung into operating position and secured by a torsion spring 12 which pushes the toggle joint 7a through. Simultaneously the latch 20b of the coupling lever 20 engages the teeth 22 of the torsion spring coupling. As a result this coupling and, thus the drive connection between the sewing machine drive and the sewing mechanism is interrupted. Closing the lid 3 lowers the winding device in an opposite manner while simultaneously reengaging the torsion spring coupling between the machine drive and the sewing mechanism.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A winding device for a sewing machine including a sewing mechanism connected to a machine drive mechanism, by a coupling means which comprises, a sewing machine housing, said winding device being adapted to swing into said sewing machine housing and be covered by a lid when not being used, a two-armed hinge support pivotally disposed on the housing, said two-armed hinge support being connected to said lid, one arm of said two-armed hinge support being connected by a lever mechanism with a support means, and said support means being pivotally attached to the sewing machine housing for the winding device forming a toggle joint such that when the lid is opened the toggle joint is extended and the winding device is brought into its operating position and secured there while the other arm of the two-armed hinge support disengages said coupling between the machine drive mechanism and the sewing mechanism.

2. The winding device according to claim 1, wherein a spring means is disposed between the support means, the winding device and the one arm of said two-armed hinge support, said spring means holding the toggle joint in its extended position when the lid is open, and operating in the opposite direction when the lid is closed, to hold the lid in its closed position.

3. The winding device according to claim 1, wherein said other arm of the hinge support works together with the coupling means, pivotingly attached to the housing, said coupling means being provided with a latch means which, when the lid opens, engages a ratchet wheel of the cover sleeve of a torsion spring coupling and simultaneously acts as the coupling.

* * * * *